United States Patent [19]

Zaweski

[11] 4,439,336

[45] * Mar. 27, 1984

[54] LUBRICANT COMPOSITION CONTAINING MIXED FATTY ACID ESTER AND AMIDE OF DIETHANOLAMINE

[75] Inventor: Edward F. Zaweski, Town and Country, Mo.

[73] Assignee: Ethyl Corporation, Richmond, Va.

[ * ] Notice: The portion of the term of this patent subsequent to Jun. 17, 1997 has been disclaimed.

[21] Appl. No.: 279,588

[22] Filed: Jul. 1, 1981

Related U.S. Application Data

[63] Continuation of Ser. No. 126,726, Mar. 3, 1980, abandoned, which is a continuation-in-part of Ser. No. 959,935, Nov. 13, 1978, Pat. No. 4,208,293.

[51] Int. Cl.[3] ..... C10M 1/48

[52] U.S. Cl. ..... 252/32.7 E; 252/51.5 A

[58] Field of Search ..... 252/51.5 A, 32.7 E

[56] References Cited

U.S. PATENT DOCUMENTS

| | | | |
|---|---|---|---|
| 1,985,687 | 12/1934 | Nuesslein et al. | 252/51.5 A X |
| 2,018,758 | 10/1935 | Ellis | 252/51.5 A X |
| 2,403,067 | 7/1946 | Fischer et al. | 252/51.5 A X |
| 2,967,831 | 1/1961 | Hommer | 252/51.5 A X |
| 3,324,033 | 6/1967 | Knapp | 252/51.5 A |
| 3,458,444 | 7/1969 | Shepherd et al. | 252/51.5 A |
| 3,509,052 | 4/1970 | Murphy | 252/34.7 |
| 3,542,678 | 11/1970 | Bork | 252/51.5 A |
| 3,746,644 | 7/1973 | Magne et al. | 252/51.5 A |
| 4,118,331 | 10/1978 | Jahnke | 252/32.7 E |
| 4,314,907 | 2/1982 | Defretin et al. | 252/32.7 E X |

*Primary Examiner*—Andrew Metz

*Attorney, Agent, or Firm*—Donald L. Johnson; John F. Sieberth; Joseph D. Odenweller

[57] ABSTRACT

Lubricating oil adapted for use as a crankcase lubricant in internal combustion engines containing a friction-reducing amount of a fatty acid amide or ester of diethanolamine.

8 Claims, No Drawings

LUBRICANT COMPOSITION CONTAINING MIXED FATTY ACID ESTER AND AMIDE OF DIETHANOLAMINE

This application is a continuation of application Ser. No. 126,726, filed Mar. 3, 1980, now abandoned, which in turn is a continuation-in-part of application Ser. No. 959,935, filed Nov. 13, 1978, now U.S. Pat. No. 4,208,293.

BACKGROUND

In order to conserve energy, automobiles are now being engineered to give improved gasoline mileage compared to those in recent years. This effort is of great urgency as a result of Federal regulations recently enacted which compel auto manufacturers to achieve prescribed gasoline mileage. These regulations are to conserve crude oil. In an effort to achieve the required mileage, new cars are being down-sized and made much lighter. However, there are limits in this approach beyond which the cars will not accommodate a typical family.

Another way to improve fuel mileage is to reduce engine friction. The present invention is concerned with this latter approach.

Polyethoxylated oleamide containing an average of 5 oxyethylene units is commercially available under the name "Ethomid" (registered trademark, Armak Company). Reference to its use as a demulsifier in lubricating oil appears in U.S. Pat. No. 3,509,052.

SUMMARY

According to the present invention, lubricating oils are provided which reduce friction between sliding metal surfaces in internal combustion engines. The reduced friction results from the addition to the lubricating oil of a small amount of a fatty acid amide or ester of diethanol amine.

DESCRIPTION OF THE PREFERRED EMBODIMENTS

A preferred embodiment of the invention is a lubricating oil composition comprising a major amount of lubricating oil and a minor friction-reducing amount of an oil-soluble additive selected from the group consisting of fatty acid amides of diethanolamine, fatty acid esters of diethanolamine, fatty acid ester-amides of diethanolamine and mixtures thereof.

The additives can be made by forming a mixture of a fatty acid and diethanolamine and heating the mixture to remove water. Optionally, a water immiscible inert solvent such as toluene or xylene can be included to aid in the removal of water.

About 0.8–3 moles, more preferably 1–3 moles of fatty acid are used per mole of diethanolamine. The reaction proceeds to yield mainly amide according to the following equation:

$$R{-}COOH + HN{\leftarrow}C_2H_4OH)_2 \; R\overset{O}{\overset{\|}{C}}{-}N{-}(C_2H_4OH)_2$$

wherein R is a hydrocarbon residue of the fatty acid.

Some of the diethanolamine can react to form ester according to the following equation:

$$RCOOH + HN{\leftarrow}C_2H_4OH)_2 \longrightarrow RC{-}OC_2H_4{-}NH{-}C_2H_4OH.$$

Because of the relative low reactivity of the hydroxy group, the second main components are the fatty acid ester-amides of diethanolamine formed according to the following equations:

$$2\,RCOOH + HN\begin{matrix}C_2H_4OH\\C_2H_4OH\end{matrix} \longrightarrow RC{-}\underset{\underset{C_2H_4OH}{|}}{N}{-}C_2H_4O{-}\overset{O}{\overset{\|}{C}}{-}R$$

Such ester-amides are within the scope of the invention.

In practice when oleic acid is reacted with diethanolamine in approximately equal mole amounts, the principal component has been found to be N,N-bis-(2-hydroxyethyl)oleamide in amounts of about 50–80 weight percent. Lesser amounts of about 10–40 weight percent of 2-[N-(2-hydroxyethyl)oleamido]ethyl oleate also forms.

Preferred fatty acids used in making the friction-reducing additive are those containing about 8–20 carbon atoms. Examples of these are caprylic acid, pelargonic acid, capric acid, undecylic acid, lauric acid, tridecoic acid, myristic acid, stearic acid, arachidic acid and the like.

More preferably the fatty acid is an unsaturated fatty acid such as hypogeic acid, oleic acid, linoleic, elaidic acid, erucic acid, brassidic acid, tall oil fatty acids and the like.

More preferably the fatty acid is oleic acid. Thus, the preferred additives are N,N-bis-(2-hydroxyethyl)oleamide, and 2-[N-(2-hydroxyethyl)oleamido]ethyl oleate and mixtures thereof.

The components can be separated by distillation and used separately in lubricating oil compositions. Preferably they are not separated, but are used as mixtures. The reaction mixtures contain other minor components which have not been identified, but are believed to contribute to the friction-reducing properties of the reaction mixture. Hence, a most preferred embodiment of the invention is a product made by the process comprising reacting (a) about 0.8–3 moles of a $C_{8-20}$ fatty acid or fatty acid producing compound with (b) one mole of diethanolamine, while removing water formed in the reaction, said improvement resulting in reduced engine friction and improved fuel economy.

Fatty acid producing compounds can be used in place of the fatty acid. These include fatty acid anhydrides, esters, halides, ammonium salts and the like. For example, methyl oleate will react with diethanolamine in a manner similar to oleic acid by liberation of methanol which can be distilled out much like water. Such reaction mixtures are included within the scope of the invention.

The following examples serve to illustrate the method of making the present additive.

EXAMPLE 1

In a reaction vessel was placed 52.5 gms (0.5 mol) of diethanolamine and 141 gms (0.5 mol) of oleic acid (caution exotherm). The mixture was stirred under nitrogen and heated to 188° C. over a two-hour 13-minute period while distilling out water. The resultant product was mainly N,N-(2-hydroxyethyl)oleamide.

EXAMPLE 2

In a reaction vessel was placed 282 gms of oleic acid, 105 gms diethanol amine and a small amount of xylene. The mixture was stirred under nitrogen and heated from 165°-185° C. over a two-hour period while distilling out water and returning xylene. The xylene was then stripped from the mixture under vacuum leaving 363 gms of a viscous liquid product consisting mainly of N,N-bis-(2-hydroxyethyl)oleamide.

EXAMPLE 3

In a reaction vessel was placed 5085 gms of oleic acid, 1893 gms diethanolamine and 1300 ml toluene. The mixture was heated to reflux (135°-151° C.) under nitrogen. Water was distilled out over a 4-hour period using a Dean-Stark water separator. Following this, toluene was distilled out by heating to 120° at 20 mm Hg abs. The acid number of the reaction product was 4.91 mg KOH/g. The reaction product was heated at 95° C. at 50 mm Hg abs for 64 hours. After this heat treatment, the acid number was lowered to 1.85. The product was subjected to high pressure liquid chromatography (HPLC) treatment to separate it into its components. Six components were isolated. Two of the principal components were identified by infrared, NMR and elemental analysis to be N,N-bis-(2-hydroxyethyl)oleamide (52.9%) and 2-[N-(2-hydroxyethyl)oleamido]ethyl oleate (35.7%). This reaction product was an excellent friction reducer.

EXAMPLE 4

In a reaction vessel was placed 5084.5 gms oleic acid, 1892.5 gms diethanolamine and 1300 ml toluene. The mixture was stirred and heated, distilling off water and toluene using a Dean-Stark separator up to a temperature of 163° C. Pressure was then reduced to 30 mm Hg abs and residual water and toluene were distilled out up to 105° C. (60° C. overhead). This product was analyzed by HPLC to be 67% N,N-bis-(2-hydroxyethyl)oleamide and 24.8% 2-[N-(2-hydroxyethyl)oleamido]ethyl oleate. This reaction mixture was an effective fuel economy additive in formulated motor oil.

Other fatty acids can be substituted for oleic acid in the above examples with good results. Alternatively, the amide can be made by reacting one mole of oleamide with about two moles of ethylene oxide. The additives are used in an amount sufficient to reduce the sliding friction of metal surfaces lubricated by oil containing the additive. An effective concentration is about 0.05-5 weight percent. More preferably, the use concentration is about 0.2-1 weight percent.

The base lubricating oil may be mineral lubricating oil or synthetic lubricating oil. Useful mineral oils include all those of suitable lubricating viscosity. Representative synthetic oils include olefin oligomers such as α-decene trimer and tetramer, alkyl benzenes such as didodecyl benzene, esters such as dinonyl adipate, trimethylolpropane tripelargonate, and complex esters made from polycarboxylic acids and polyols with a monocarboxylic acid or monohydric alkanol end group.

Blends of mineral oil and synthetic oil are very useful. For example, a blend of about 80% 150 SUS mineral oil and 20% α-decene trimer gives a very useful base lubricating oil. Likewise, blends of synthetic esters with mineral oil are very useful. For example, a blend of 15 weight percent di-2-ethylhexyl adipate and 85 weight percent 150 SUS mineral oil is a very effective base lubricating oil for use in an engine crankcase.

Improved results are obtained when a zinc dihydrocarbyl dithiophosphate (ZDDP) is used in combination with the present additives. The amount can vary over a wide range. It is usually expressed in terms of zinc content of the oil. Formulated oil would include 0.01-0.3 weight percent zinc as ZDDP. A preferred range is about 0.05-0.15 weight percent zinc.

The ZDDP may be aryl type or alkyl type. A representative aryl type ZDDP is zinc di-nonylphenyl dithiophosphate. Preferably, an alkyl type ZDDP is used. Examples of these are zinc isobutyl amyl dithiophosphate, zinc di-(2-ethylhexyl)dithiophosphate and the like.

Other additives may be included such as alkaline earth metal phenates and sulfurized phenates, alkaline earth hydrocarbyl sulfonates such as calcium petroleum sulfonate, magnesium alkyl benzene sulfonate, overbased calcium alkyl benzene sulfonate and the like. Phosphosulfuried terpene and polyolefins and their alkaline earth metal salts may be included. Viscosity index improvers such as the poly-alkyl methacrylate or ethylene-propylene copolymers, ethylenepropylene non-conjugated diene terpolymers are also useful VI improvers in lubricating oil. Antioxidants such as 4,4'-methylenebis-(2,6-di-tert-butylphenol) can be beneficially added to the lubricating oil.

Tests were carried out which demonstrated the friction-reducing properties of the additives. These tests have been found to correlate with fuel economy tests in automobiles. In these tests an engine with its cylinder head removed and with the test lubricating oil in its crankcase was brought to 1800 rpm by external drive. Crankcase oil was maintained at 63° C. The external drive was disconnected and the time to coast to a stop was measured. This was repeated several times with the base oil and then several times with the same oil containing one percent of a mixture prepared as described in Examples 2 and 3. The base oil was a typical commercial oil formulated for use in a crankcase. The friction-reducing additives were found to increase the coast-down time an average of 4.3% and 8.2% respectively.

Further tests were carried out in a 1977 automobile fitted with a 403 CID V8 engine. The test used was the modification of the Federal EPC city cycle. It consisted of a first 3.6 miles of the Federal EPA city cycle starting with a warmed up engine. It is referred to as the "Hot 505" cycle.

The above 1977 car with a fully formulated commercial SE grade 10W40 motor oil in its crankcase was operated on a chassis dynamometer for about one hour at 55 mph to stabilize oil temperature. It was then run through a series of three consecutive "Hot 505" cycles during which its fuel consumption was carefully measured. These results were averaged to obtain the baseline fuel economy of the car.

One-half of the oil in the engine crankcase was then removed and replaced with an equal amount of the same oil except containing 2 weight percent of an oleamide of diethanolamine consisting of about 60 wt % N,N-bis-(2-hydroxyethyl)oleamide and 30 wt % 2-[N-(2-hydroxyethyl)oleamido] ethyl oleate. This resulted in a crankcase oil containing 1 weight percent of the test additive. The car was then operated on the chassis dynamometer at 55 mph for one hour to again stabilize temperature. Then a second series of three consecutive "Hot 505" cycles was conducted while carefully measuring fuel economy. These results were averaged to give the "initial" fuel economy of the engine with the test additive.

The same 1977 Oldsmobile was operated the equivalent of 500 miles at 55 mph on the chassis dynamometer following which a third series of three consecutive "Hot 505" cycles were run while carefully measuring fuel economy. These results were averaged to give the fuel economy after 500 miles operation with the test additive.

The engine crankcase was then drained while hot and filled with flushing oil. It was operated for a short time and drained again. The crankcase was then filled with the same 10W40 motor oil not containing the test additive. The engine was run for a short time and then drained. It was refilled with the same 10W40 motor oil not containing the test additive. The engine was operated at 55 mph on the chassis dynamometer for about one hour to stabilize engine temperature. Then a fourth series of three consecutive "Hot 505" cycles was carried out while carefully measuring fuel economy. These results were averaged to obtain a final baseline thereby bracketing the tests conducted with the test additive between two baseline results.

The following table shows the results of the above-described test:

| | Fuel Economy (mpg) | |
|---|---|---|
| | initial | after 500 miles |
| 1. first baseline | 16.62 | |
| 2. with 1 wt % of oleic amide of diethanolamine | 16.80 | 16.80 |
| 3. second baseline | | 16.50 |

These results show that the addition of 1 weight percent of the mixture of oleamides of diethanolamine to a fully formulated engine crankcase oil gave an initial improvement in fuel economy of 1.1% and an improvement of 1.8% after 500 miles.

A second test series was conducted to measure the fuel economy properties of the mixture of oleamides of diethanolamine. This test series was conducted using a 1978 Chevrolet with a 302 CID V-8 engine. The engine crankcase was drained and filled with a commercial SE grade 10W40 motor oil. This was operated about 10 minutes and then drained. The crankcase was again filled with the same 10W40 motor oil. The engine was operated about 10 minutes and then drained. The crankcase was filled a third time with the same 10W40 motor oil. The car was then operated the equivalent of 1,000 miles at 55 mph on a chassis dynamometer. Following this the car was operated through the full 1975 Federal EPA city cycle starting with a warmed-up engine. Fuel consumption was carefully measured. The car was then operated through the full 1975 Federal EPA highway cycle. Fuel consumption was carefully measured. The car was then operated through both the city and highway cycle two more times while measuring fuel consumption. These results were averaged to obtain a first baseline.

The same 1978 Chevrolet was then taken through the same procedure set forth in the previous paragraph except that this time 0.5 weight percent of the mixture of oleamides of diethanolamine was added to the commercial SE 10W40 motor oil. The four city and four highway results were averaged to give a city and highway fuel economy rating for the car with 0.5 weight percent of the test additive.

Following this, the same 1978 Chevrolet was taken through the same procedure set forth two paragraphs above using the same commercial SE 10W40 motor oil without the test additive. The four city and four highway results were averaged to give a second city and highway baseline fuel economy rating.

The first and second baseline fuel economy ratings were subjected to linear regression analysis to develop a statistical baseline which takes into account variations in barometric pressure, humidity and any trend in baseline economy which developed during the test in order to obtain a statistically significant baseline.

The following table sets forth the results of the test with the 1978 Chevrolet:

| | City Cycle (mpg) | Highway (mpg) |
|---|---|---|
| 1. statistical baseline | 15.13 | 19.52 |
| 2. with 0.5% mixture of oleamides of diethanolamine | 15.27 | 19.68 |
| 3. percent improvement | 0.9 | 0.8 |

That statistical analysis of the above data showed that the improvement in fuel economy is real with 99% confidence.

I claim:

1. In a lubricating oil composition formulated for use in the crankcase of an internal combustion engine, said composition containing 0.01–3 weight percent zinc in the form of zinc dihydrocarbyldithiophosphate, the improvement of including in said composition about 0.05–5 weight percent of a reaction product formed by the process comprising reacting (a) about 1–3 moles of a $C_{8-20}$ fatty acid with (b) one mole of diethanolamine while removing water formed in the reaction, said reaction product consisting mainly of N,N-bis-(2-hydroxyethyl) fatty amide and fatty acid ester thereof, said improvement resulting in reduced engine friction and improved fuel economy.

2. A formulated lubricating oil of claim 1 wherein said fatty acid is oleic acid.

3. A formulated lubricating oil of claim 2 wherein said reaction product is formed by reacting about one mole of oleic acid with one mole of diethanolamine.

4. In a lubricating oil formulated for use in the crankcase of an internal combustion engine, said composition containing 0.01–0.3 weight percent zinc in the form of zinc dihydrocarbyldithiophosphate, the improvement of including in said formulated oil about 0.05–5 weight percent of an ester-amide mixture comprising as principal components:

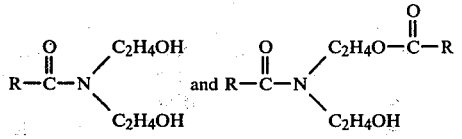

wherein R is the aliphatic hydrocarbon residue of a fatty acid, said fatty acid containing about 8–20 carbon atoms, said improvement resulting in reduced engine friction and increased fuel economy.

5. A formulated lubricating oil of claim 4 wherein R is the aliphatic hydrocarbon residue of linoleic acid.

6. A formulated lubricating oil of claim 4 wherein R is the aliphatic hydrocarbon residue of tall oil fatty acid.

7. A formulated lubricating oil of claim 4 wherein R is the aliphatic hydrocarbon residue of oleic acid.

8. A formulated lubricating oil of claim 7 wherein said ester-amide mixture comprises about 50–80 weight percent N,N-bis-(2-hydroxyethyl)oleamide and 10–40 weight percent of 2-[N-(2-hydroxyethyl)oleamido]ethyl oleate.

* * * * *